US011583012B2

(12) United States Patent
Sanders

(10) Patent No.: US 11,583,012 B2
(45) Date of Patent: Feb. 21, 2023

(54) COOLING KNEE PAD

(71) Applicant: Jacob Ernest Roy Sanders, Newport, WA (US)

(72) Inventor: Jacob Ernest Roy Sanders, Newport, WA (US)

( * ) Notice: Subject to any disclaimer, the term of this patent is extended or adjusted under 35 U.S.C. 154(b) by 246 days.

(21) Appl. No.: 17/079,742

(22) Filed: Oct. 26, 2020

(65) Prior Publication Data

US 2021/0120891 A1 Apr. 29, 2021

Related U.S. Application Data

(60) Provisional application No. 62/925,989, filed on Oct. 25, 2019.

(51) Int. Cl.
*A41D 13/06* (2006.01)
*A41D 13/005* (2006.01)
*A41D 13/05* (2006.01)

(52) U.S. Cl.
CPC ..... *A41D 13/065* (2013.01); *A41D 13/0053* (2013.01); *A41D 13/0568* (2013.01)

(58) Field of Classification Search
CPC ..... A41D 13/065; A41D 13/0053; A41D 13/0568
See application file for complete search history.

(56) References Cited

U.S. PATENT DOCUMENTS

| | | | | |
|---|---|---|---|---|
| 4,561,123 | A | 12/1985 | Hull | |
| 11,406,142 | B1 * | 8/2022 | Lozornio | F16G 11/143 |
| 2003/0019007 | A1 | 1/2003 | Spencer | |
| 2005/0187598 | A1 | 8/2005 | Shimizu et al. | |
| 2007/0205054 | A1 | 9/2007 | Gentles et al. | |
| 2012/0172959 | A1 * | 7/2012 | Lachenbruch | A61F 7/0085 5/423 |
| 2015/0026859 | A1 | 1/2015 | Norris | |
| 2016/0007661 | A1 * | 1/2016 | Leon | F24F 1/04 62/259.3 |
| 2016/0076818 | A1 * | 3/2016 | Lau | F25B 9/004 165/104.34 |
| 2018/0064182 | A1 * | 3/2018 | Brockway | A61F 13/085 |
| 2019/0104778 | A1 * | 4/2019 | Giannacco | F41H 1/02 |
| 2021/0120891 | A1 * | 4/2021 | Sanders | A41D 13/0053 |

* cited by examiner

*Primary Examiner* — Gloria M Hale
(74) *Attorney, Agent, or Firm* — Boudwin Intellectual Property; Daniel Boudwin

(57) ABSTRACT

A cooling knee pad includes a housing having a base, a perimeter wall extending upwardly from the base, and an upper end defining an interior volume. A pad is affixed to the upper end of the housing. A power supply is operably connected to a cooling mechanism disposed within the interior volume of the housing. The cooling mechanism may include a Peltier cooling unit including a radiator, an electric fan, a water pump, and at least one buck converter. A pair of adjustable fasteners affixed to the housing is configured to secure the housing to a user such that the pad contacts a knee of the user. In this way, the user can kneel on the pad to comfortably support the knee and cool the knee with the cooling mechanism.

19 Claims, 3 Drawing Sheets

COOLING KNEE PAD

CROSS REFERENCE TO RELATED APPLICATIONS

This application claims the benefit of U.S. Provisional Application No. 62/925,989 filed on Oct. 25, 2019. The above identified patent application is herein incorporated by reference in its entirety to provide continuity of disclosure.

BACKGROUND OF THE INVENTION

The present invention relates to a knee pad. More particularly, the present invention pertains to a knee pad having a powered cooling mechanism that provides cooling to the knee area while the pad supports the knee in a comfortable manner.

Many activities and work projects require an individual to kneel down and support their weight on their knees to access a particular area. For example, gardening, painting, home maintenance, and many other tasks require the individual to kneel down while working. Kneeling even for short periods of time can quickly become uncomfortable. Medical issues with the knee are common, and individuals experiencing such issues can experience extreme discomfort when kneeling to complete a task, to the point where the very act of kneeling may not be possible for them without some kind of additional support. Even individuals with completely healthy knees will experience discomfort and pain after kneeling for extended periods of time.

One way to address these issues is to utilize a padded surface or knee pad to support the knees. While regular padding can provide some additional comfort and pain relief when kneeling for extended periods, there are still drawbacks to this solution. A padded material often retains heat and causes the knees of the user to increase in temperature and sweat. The increased moisture can irritate the skin and cause other discomfort, such as ingrown hairs for example. This may lead the user to forgo a knee pad entirely, which only leads to long term knee issues. In view of the above concerns, it is desirable to provide a cooling knee pad with an active cooling mechanism for cooling the knee area.

Devices have been disclosed in the known art that relate to knee pads. These include devices that have been disclosed in patent application publications and issued patents. However, the devices have several drawbacks. Some known art devices provide garments with internally situated padding. The padding in these types of devices is not adjustable and often becomes quickly destroyed or moved around within the confines of the garment, reducing its overall effectiveness during use. It also can increase the heat retention and sweat production. There exist kneeling pads that are standalone devices, some of which can be attached to the user for convenience, but these too have drawbacks. Standalone kneeling pads can wear and break down over time. Such kneeling pads take up valuable storage space that could be reserved for other important items. Individual knee pads must be transported to an area for use, which can be a time-consuming inconvenience. Further, the prior art is lacking in a knee pad device that includes active cooling.

In light of the devices disclosed in the known art, it is submitted that the present invention substantially diverges in design elements from the prior art and consequently it is clear that there is a need in the art for an improvement to existing knee pad devices. In this regard the present invention substantially fulfills these needs.

SUMMARY OF THE INVENTION

In view of the foregoing disadvantages inherent in the known types of knee pads now present in the prior art, the present invention provides a cooling knee pad that comfortably supports the user's knee while providing active cooling to the knee area. In one embodiment, the cooling knee pad includes a housing having a base, a perimeter wall extending upwardly from the base, and an upper end defining an interior volume. A pad is affixed to the upper end of the housing for supporting a user's knee. A power supply is operably connected to a cooling mechanism disposed within the interior volume of the housing, such that the cooling mechanism cools the pad, thereby cooling the knee area of the user. A pair of adjustable fasteners affixed to the housing are configured to secure the housing to the user such that the pad supports the user's knee. The user can secure a pair of cooling knee pads to comfortably support themselves in a kneeling position for extended periods while the knee and surrounding leg area is actively cooled.

It is therefore an object of the present invention to provide a new and improved knee pad assembly that includes features lacking in the known art, namely the ability to comfortably support the user's knees while actively cooling the knee area.

Another object of the present invention is to provide a cooling knee pad that utilizes Peltier cooling units to cool the pad that supports the user's knee.

Other objects, features, and advantages of the present invention will become apparent given the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
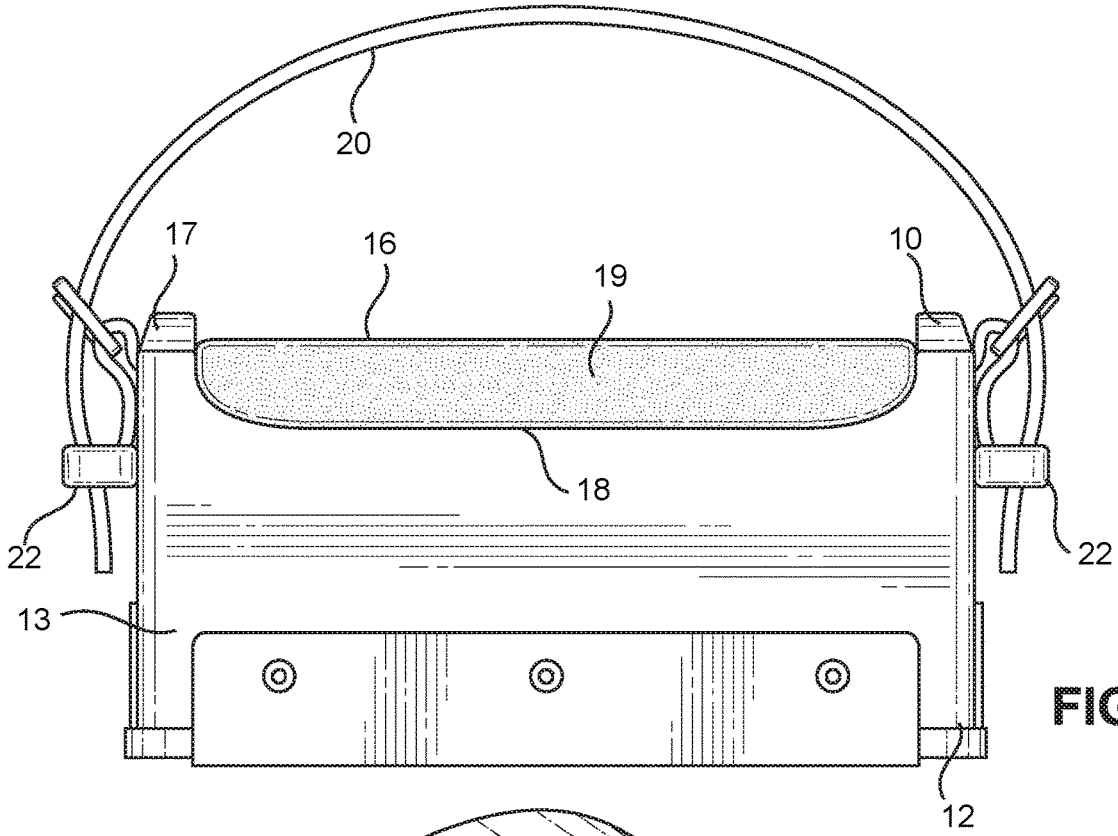
FIG. 1 shows an end elevation view of an embodiment of the cooling knee pad.

Reference is made herein to the attached drawings. Like reference numerals are used throughout the drawings to depict like or similar elements of the retractable floor cover. For the purposes of presenting a brief and clear description of the present invention, the preferred embodiment will be discussed as used for supporting a user's knees while actively cooling the knee and surrounding leg area. The figures are intended for representative purposes only and should not be considered to be limiting in any respect.

As referred to herein, the term "Peltier cooling unit" refers to any powered cooling mechanism that utilizes thermoelectric cooling or the Peltier effect to create a heat flux at the junction of two different types of materials, such that heat from one side of the device to the other.

Figure 2:
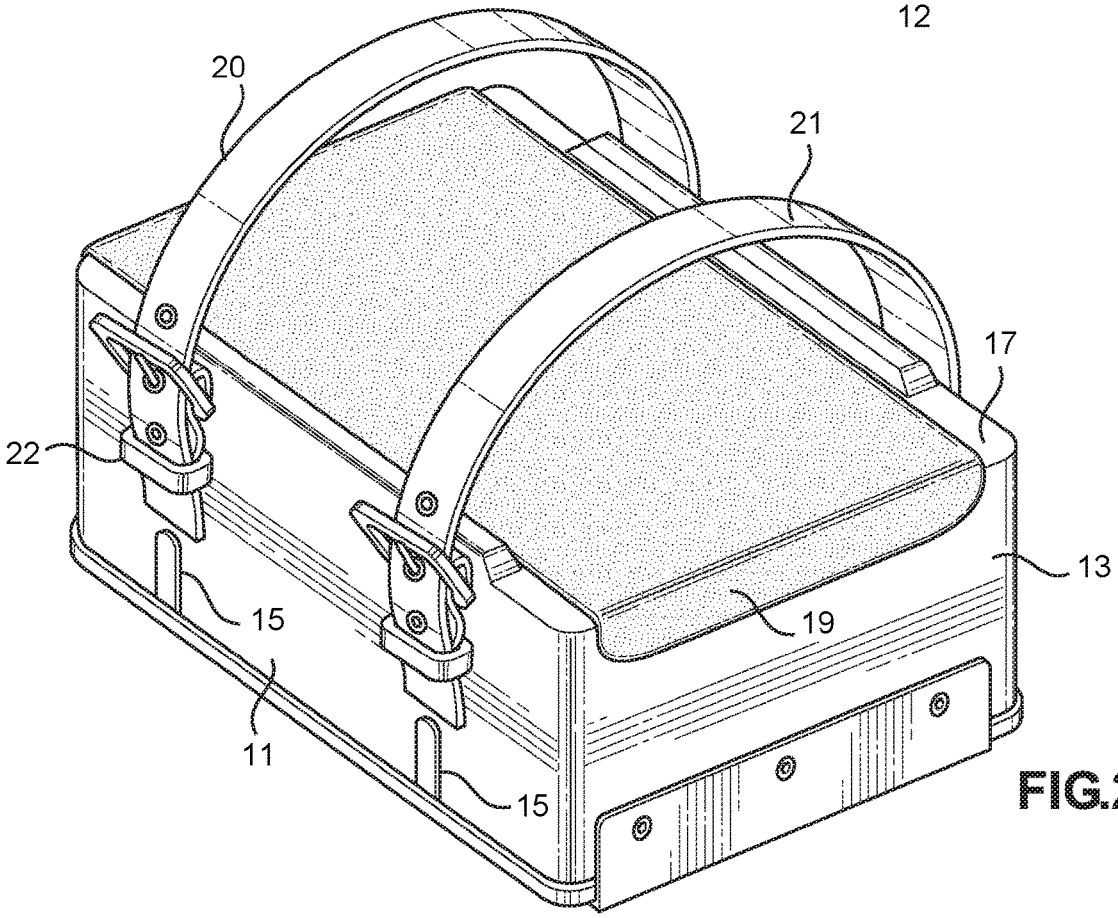
FIG. 2 shows a perspective view of an embodiment of the cooling knee pad.

Referring now to FIGS. 1 and 2, there is shown an end elevation view of an embodiment of the cooling knee pad and perspective view of an embodiment of the cooling knee pad, respectively. The cooling knee pad 10 generally includes a housing 11 having a base 12, a perimeter wall 13 extending upwardly from the base 12, and an upper end 14 defining an interior volume (visible in FIG. 3). In the shown embodiment, the housing 11 is generally rectangular to conform to the leg of an individual wearing the cooling knee pad 10. However, other embodiments can include different shapes.

A pad 16 is affixed to the upper end 14 of the housing 11. The pad 16 is adapted to provide support to the user's knee and can include a compressible foam material or any other suitable padded material. In some embodiments, the pad 16 is removably secured to the upper end 14 of the housing 11 via frictional engagement between the pad 16 and an interior edge of the perimeter wall 13 of the housing 11. This allows users to utilize pads 16 having different properties for their personal comfort including different thicknesses, for example. In the shown embodiment, an upper edge 17 of the perimeter wall of the housing includes a recessed portion 18 adapted to expose a side edge 19 of the pad 16. This allows users to easily grasp the pad 16 to facilitate removal or installment of the pad 16.

The cooling knee pad 10 includes a pair of adjustable fasteners 20, 21 affixed to the housing 11. The adjustable fasteners 20, 21 are configured to secure the housing 11 to a user such that the pad 16 contacts and supports the user's knee. In the shown embodiment, the adjustable fasteners 20, 21 are adjustable straps and buckles affixed via a mounting member to the perimeter wall of the housing 11. When the cooling knee pad 10 is worn by the user, one strap adjustably secures around the user's leg above the knee, while the other strap adjustable secures around the user's leg below the knee. This secures the cooling knee pad 10 to the user, allowing them to easily reposition themselves or move to a different area without having to carry the cooling knee pad 10 with the hands.

Figure 3:
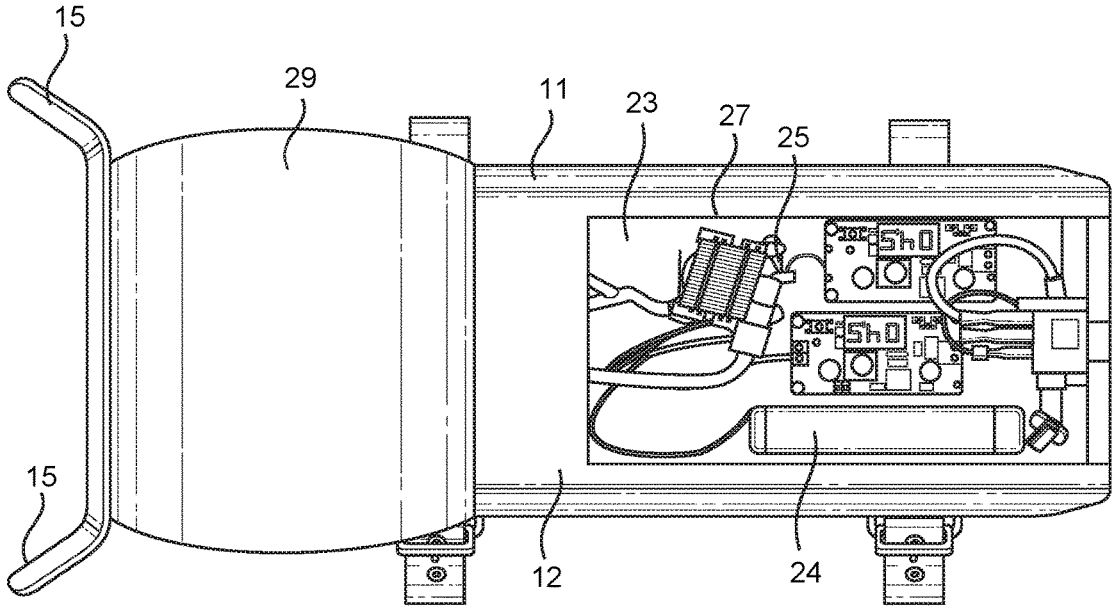
FIG. 3 shows a bottom plan view of an embodiment of the cooling knee pad with the flexible cover and base plate removed to expose the interior volume and electronics.

Referring now to FIG. 3, there is shown a bottom plan view of an embodiment of the cooling knee pad with the flexible cover and base plate removed to expose the interior volume and electronics. The base 12 of the housing 11 includes an opening 27 that provides access to the interior volume 23 of the housing 11, which houses the electronic components of the cooling knee pad. The interior volume 23 includes a power supply 24 operably connected to one or more cooling mechanisms 25 disposed within the interior volume 23 of the housing 11. In the shown embodiment, the cooling mechanism 25 is a Peltier cooling unit that is positioned such that the cool side of the unit contacts the underside of the pad. When the Peltier cooling unit is activated via a power switch, the cool side of the unit reduces the temperature of the pad. The power switch can be disposed externally on the housing 11 or internally within the interior volume 23 of the housing 11. In one embodiment, the power supply includes a battery, which can be easily changed by the user.

Figure 4:
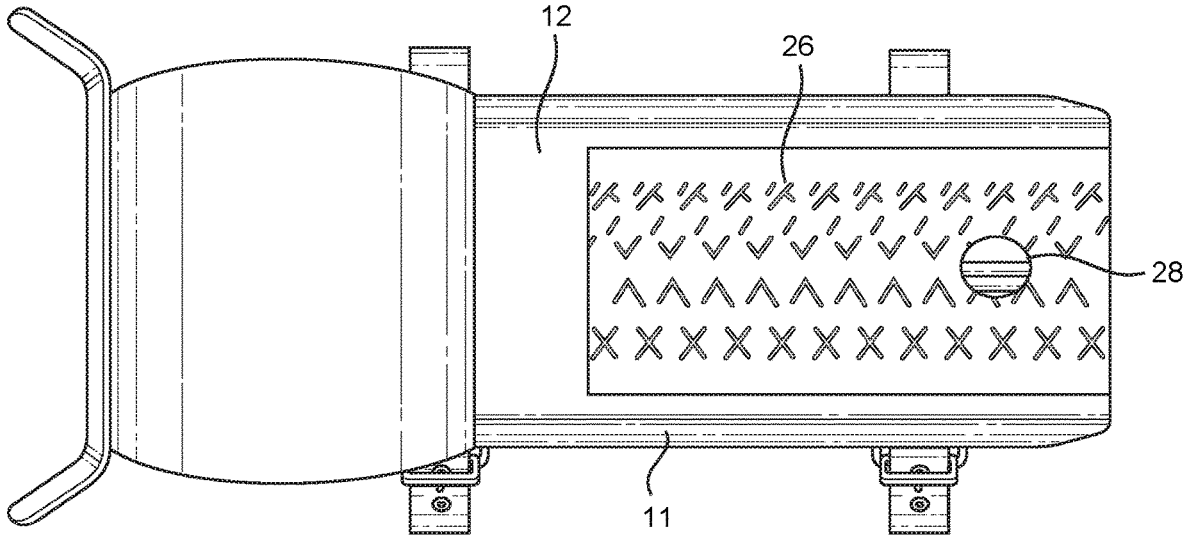
FIG. 4 shows a perspective view of an embodiment of the cooling knee pad with the flexible cover removed to expose the base plate.

Referring now to FIG. 4, there is shown a perspective view of an embodiment of the cooling knee pad with the flexible cover removed to expose the base plate. The base 12 of the housing 11 includes a rigid base plate 26 that is removably secured over the base opening 27 via any suitable type of fastener. The base plate 26 covers and protects the electronic components within the interior volume of the housing 11. In the shown embodiment, the base plate 26 includes a small aperture 28 that serves as a finger hold for easily removing or reattaching the base plate 26 as needed.

Additionally, in the shown embodiment, a flexible base cover 29 is affixed to one side of the base 12 of the housing. The flexible base cover 29 includes a cover fastener 15 configured to removably secure the flexible base cover 29 overtop the base plate 26. In the shown embodiment, the cover fastener 15 comprises a pair of flexible tabs configured to frictionally engage opposing sides of the perimeter wall 13 of the housing, as most clearly visible in FIG. 2. The flexible base cover 29 can be moved to a deployed position to cover and protect the base plate 26, and can be unfastened and rolled back to a retracted position to expose the base plate 26 for gaining access to the interior volume. Further, the flexible base cover 29 can include a high friction material, or a material having a coefficient of friction greater than one, in order to prevent the cooling knee pad 10 from sliding along the ground when support the weight of the user.

Figure 5:
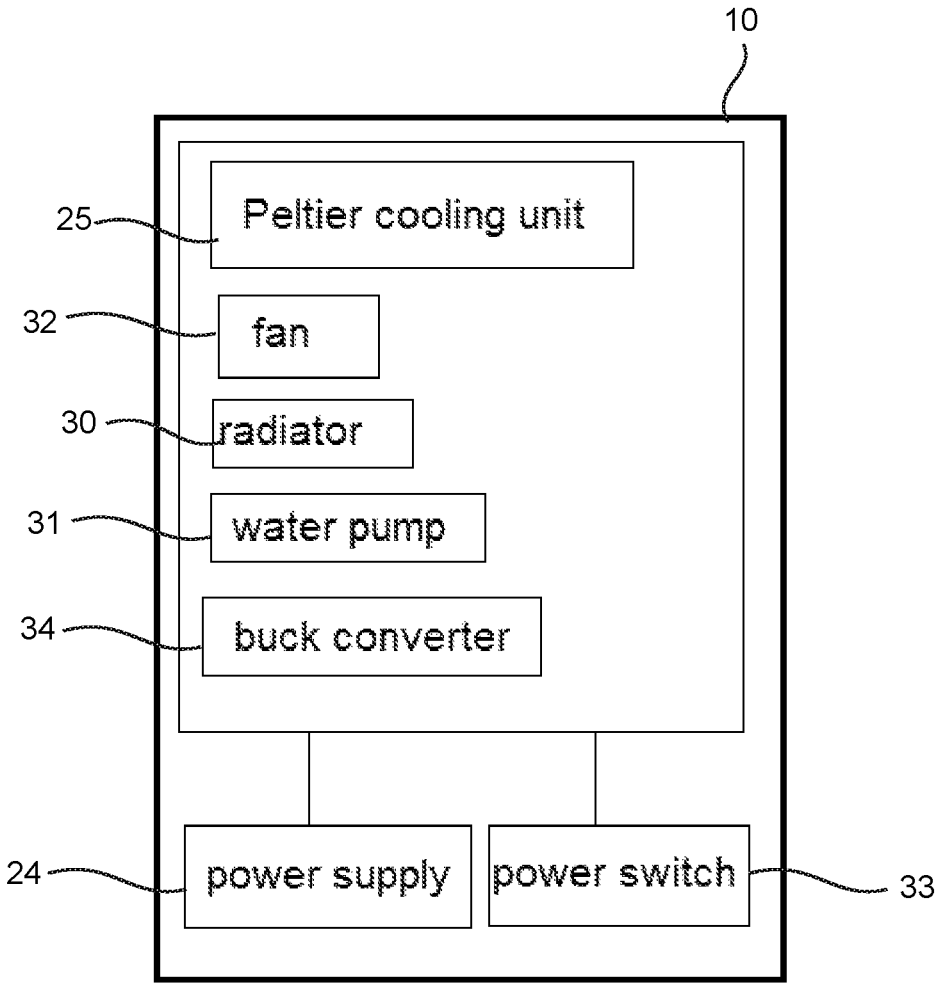
FIG. 5 shows a diagram of the components of an embodiment of the cooling knee pad.

Referring now to FIG. 5, there is shown a diagram of the components of an embodiment of the cooling knee pad. The cooling knee pad 10 includes a power supply 24 that is operably connected to a cooling mechanism 25, such as a Peltier cooling unit. The power supply 24 is further operably connected to a radiator 30, a water pump 31, and at least one buck converter 34 for voltage regulation. The radiator 30 and water pump 31 are configured to work in tandem to cool the warm side of the Peltier cooling unit, which prevents heat buildup within the interior volume and helps to maximize the effectiveness of the cool side of the unit. The power supply 24 is also operably connected to a fan 32 that is configured to cool the radiator 30 by forcing air over its surfaces. The power supply 24 is operably connected to a power switch 33 which controls operation of the cooling mechanism 25. In some embodiments, the power switch 33 may include additional operational controls. For example, the power switch 33 can include a more complex control circuit with timer controls, temperature controls, and other parameter controls. In some embodiments, the cooling mechanism 25 can be controlled wirelessly via Bluetooth, RF, or other wireless communication protocols.

In operation, the user can selectively activate the internal cooling mechanism of the cooling knee pad. The user can then secure one cooling knee pad 10 to each leg via the adjustable fasteners, such that the pad contacts the knee. When the user moves to a kneeling position, the pad supports their knee in a comfortable manner, while the cooling mechanism actively lowers the temperature of the pad. In this way, the knee and surrounding leg area of the user is kept cool and free from excess moisture buildup, allowing the user to comfortably kneel for extended periods of time.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cooling knee pad comprising:

a housing having a base, a perimeter wall extending upwardly from the base, and an upper end, defining an interior volume;

a pad affixed to the upper end of the housing;

a power supply operably connected to a cooling mechanism disposed within the interior volume of the housing, the cooling mechanism configured to cool the pad when activated;

a pair of adjustable fasteners affixed to the housing configured to secure the housing to a user such that the pad contacts a knee of the user.

2. The cooling knee pad of claim 1, wherein the pad is removably secured to the upper end of the housing via frictional engagement between the pad and an interior edge of the perimeter wall of the housing.

3. The cooling knee pad of claim 1, wherein the pair of fasteners comprises a pair of adjustable straps and buckles affixed to the perimeter wall of the housing.

4. The cooling knee pad of claim 1, wherein the base of the housing comprises an opening that provides access to the interior volume.

5. The cooling knee pad of claim 4, further comprising a base plate removably secured over the opening on the base of the housing.

6. The cooling knee pad of claim 5, wherein the base plate further comprises an aperture thereon.

7. The cooling knee pad of claim 1, further comprising a flexible base cover affixed to one side of the base of the housing, wherein the flexible base cover includes a cover fastener configured to removably secure the flexible base cover overtop the base plate.

8. The cooling knee pad of claim 7, wherein the cover fastener comprises a pair of flexible tabs configured to frictionally engage opposing sides of the perimeter wall of the housing.

9. The cooling knee pad of claim 1, wherein the power supply comprises a battery.

10. The cooling knee pad of claim 1, wherein an upper edge of the perimeter wall of the housing includes a recessed portion adapted to expose a side edge of the pad.

11. A cooling knee pad comprising:

a housing having a base, a perimeter wall extending upwardly from the base, and an upper end defining an interior volume;

a pad affixed to the upper end of the housing;

a power supply operably connected to a cooling mechanism disposed within the interior volume of the housing, the cooling mechanism comprising a Peltier cooling unit including a radiator, an electric fan, a water pump, and at least one buck converter, the cooling mechanism configured to cool the pad when activated;

a pair of adjustable fasteners affixed to the housing configured to secure the housing to a user such that the pad contacts a knee of the user.

12. The cooling knee pad of claim 11, wherein the pad is removably secured to the upper end of the housing via frictional engagement between the pad and an interior edge of the perimeter wall of the housing.

13. The cooling knee pad of claim 11, wherein the pair of fasteners comprises a pair of adjustable straps and buckles affixed to the perimeter wall of the housing.

14. The cooling knee pad of claim 11, wherein the base of the housing comprises an opening that provides access to the interior volume.

15. The cooling knee pad of claim 14, further comprising a base plate removably secured over the opening on the base of the housing.

16. The cooling knee pad of claim 15, wherein the base plate further comprises an aperture thereon.

17. The cooling knee pad of claim 10, further comprising a flexible base cover affixed to one side of the base of the housing, wherein the flexible base cover includes a cover fastener configured to removably secure the flexible base cover overtop the base plate.

18. The cooling knee pad of claim 17, wherein the cover fastener comprises a pair of flexible tabs configured to frictionally engage opposing sides of the perimeter wall of the housing.

19. The cooling knee pad of claim 10, wherein the power supply comprises a battery.

* * * * *